US010896662B2

(12) United States Patent
Wish

(10) Patent No.: US 10,896,662 B2
(45) Date of Patent: Jan. 19, 2021

(54) GO DRUM

(71) Applicant: David Wish, Montclair, NJ (US)

(72) Inventor: David Wish, Montclair, NJ (US)

( * ) Notice: Subject to any disclaimer, the term of this patent is extended or adjusted under 35 U.S.C. 154(b) by 0 days.

(21) Appl. No.: 16/867,519

(22) Filed: May 5, 2020

(65) Prior Publication Data

US 2020/0265813 A1 Aug. 20, 2020

Related U.S. Application Data

(63) Continuation-in-part of application No. 16/025,876, filed on Jul. 2, 2018, now Pat. No. 10,714,061, which is a continuation of application No. 15/430,431, filed on Feb. 10, 2017, now Pat. No. 10,013,960.

(51) Int. Cl.

| | |
|---|---|
| ***G10D 13/02*** | (2020.01) |
| ***G10D 13/06*** | (2020.01) |
| ***G10D 13/11*** | (2020.01) |
| ***G10D 13/18*** | (2020.01) |

(52) U.S. Cl.

CPC ..... *G10D 13/02* (2013.01); *G10D 13/06* (2013.01); *G10D 13/11* (2020.02); *G10D 13/18* (2020.02)

(58) Field of Classification Search

CPC ..... G10D 13/02; G10D 13/18; G10D 13/11; G10D 13/06; G10D 13/01; G10K 3/00

See application file for complete search history.

(56) References Cited

U.S. PATENT DOCUMENTS

| | | | | |
|---|---|---|---|---|
| 8,927,842 | B1 * | 1/2015 | Honjo | G10D 13/18 84/411 R |
| 2007/0221040 | A1 * | 9/2007 | Bailey | G10D 13/00 84/411 R |

* cited by examiner

*Primary Examiner* — Kimberly R Lockett

(57) ABSTRACT

A compact drum kit is provided. The drum kit has a body having a hollow interior cavity and a sound hole for transmitting sound wave from the interior cavity to exterior of the body, the body has a striking head and an opposing resonant head. The drum kit has a top plate attaching to a top side of the body and a platform attaching to a bottom side of the body. The drum kit has a shaft mounting bracket attaching to the top plate and a pivot shaft mounting bracket attaching to the top plate. A plurality of upward extending component mounting shafts are supported by one of the shaft mounting bracket and the pivot shaft mounting bracket. One or more percussion modules that attach to one or more of the plurality of component mounting shafts, wherein each percussion module produces a sound in response to being struck or scraped. A drum kick assembly is positioned on the striking head side of the body and including a beater positioned to strike the striking head of the body to produce a sound. A hi-hat pedal assembly is positioned on the resonant head side of the body.

11 Claims, 25 Drawing Sheets

GO DRUM

CROSS-REFERENCE TO RELATED APPLICATION

This application is a continuation-in-part of U.S. patent application Ser. No. 16/025,876, filed on Jul. 2, 2018, which is a continuation of U.S. patent application Ser. No. 15/430,431, filed on Feb. 10, 2017, now U.S. Pat. No. 10,013,960. All of the above applications are incorporated herein by reference in their entirety.

BACKGROUND

Technical Field

This disclosure relates generally to musical instruments and more specifically relates to a drum set.

Related Art

A drum kit, drum set, trap set, or just drums is a collection of drums and other percussion instruments set up to be played/struck by a single player. The traditional drum kit consists of a mix of drums (classified as classically as membranophones, Hornbostel-Sachs high-level classification 2) and idiophones (Hornbostel-Sachs high-level classification 1, most significantly cymbals but also including the woodblock and cowbell for example). More recently kits have also included electronic instruments (Hornbostel-Sachs classification 53), with both hybrid and entirely electronic kits now in common use.

A standard modern kit (for a right-handed player), as used in popular music and taught in many music schools, contains: a snare drum, mounted on a stand, placed between the player's knees and played with drum sticks (which may include rutes or brushes); a bass drum, played by a pedal operated by the right foot; and one or more cymbals, played with the sticks.

All of these are classed as non-pitched percussion, allowing for the music to be scored using percussion notation, for which a loose semi-standardized form exists for the drum kit. If some or all of them are replaced by electronic drums, the scoring and most often positioning remains the same, allowing a standard teaching approach. The drum kit is usually played seated on a drum stool or throne. The drum kit differs in general from those traditional instruments that produce melody or chords/pitch per se: even though drums are often placed musically alongside others that do, such as the piano or stringed instruments.

Many drummers extend their kits from this basic pattern, adding more drums, more cymbals, and many other instruments including pitched percussion. In some styles of music particular extensions are normal, for example double bass drums in heavy metal music. On the other extreme but more rarely, some performers omit elements from even the basic setup, also dependent on the style of music and individual preferences.

DESCRIPTION OF EXEMPLARY EMBODIMENTS

Traditional drum sets are very large and comprise both a large number of components and components, many of which, are large in size. Traditional drum sets are not ideal for students because drum sets are both expensive and they take up a lot of space. Traditional drum sets are also not ideal for a classroom setting, where the goal is to teach students how to play the drums. The go drum is an all-in-one drum kit. The go drum is a compact, versatile, highly portable, and self-contained drum kit.

The figures illustrate an example embodiment of a drum kit 2000, also referred to as the go drum. Reference now will be made in detail to embodiments of the disclosure, one or more examples of which are illustrated in the figures. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

Figure 19:
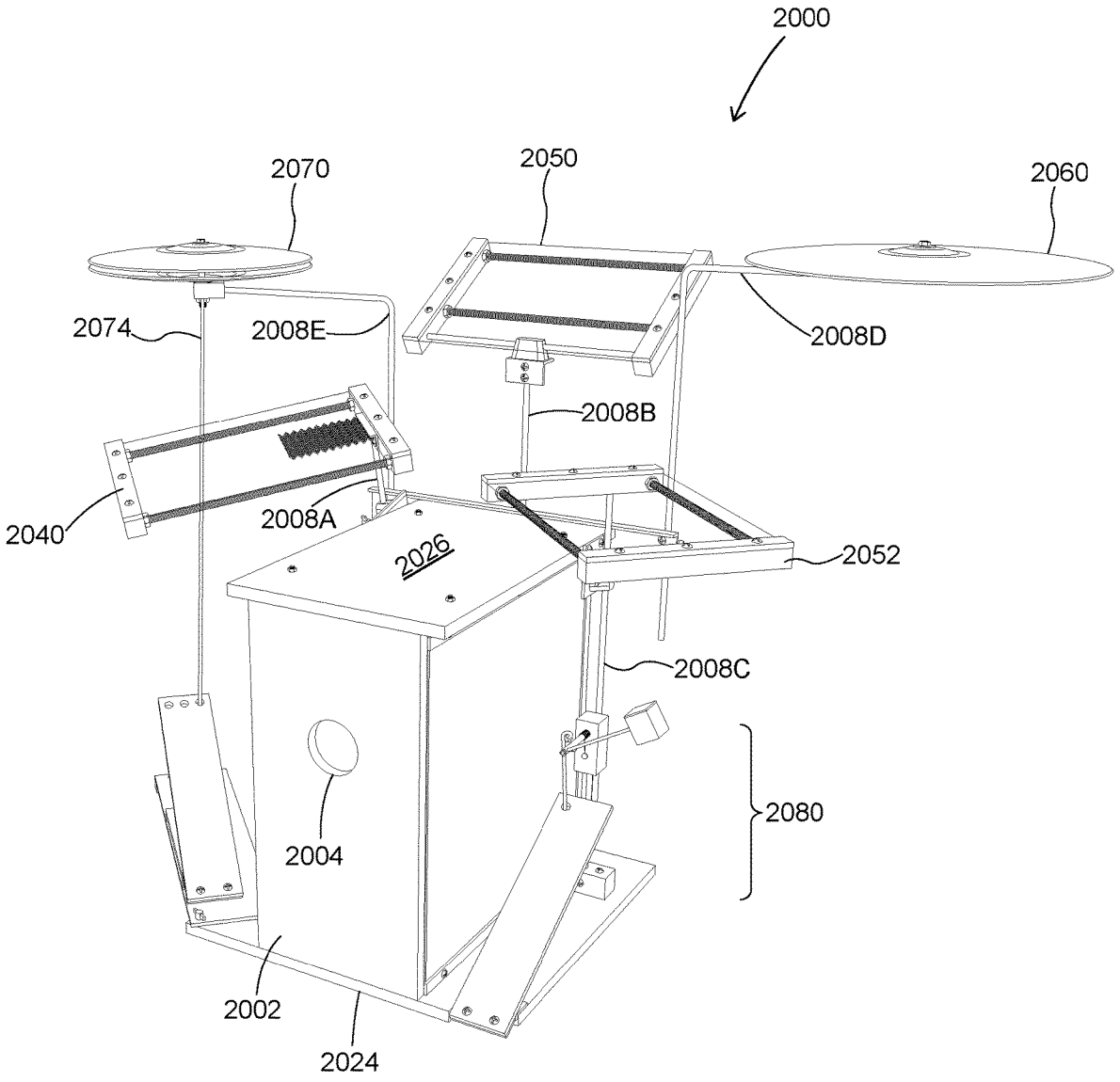
FIG. 19 illustrates a top-front-right perspective view of the exemplary go drum that is in an usage position.
Figure 20:
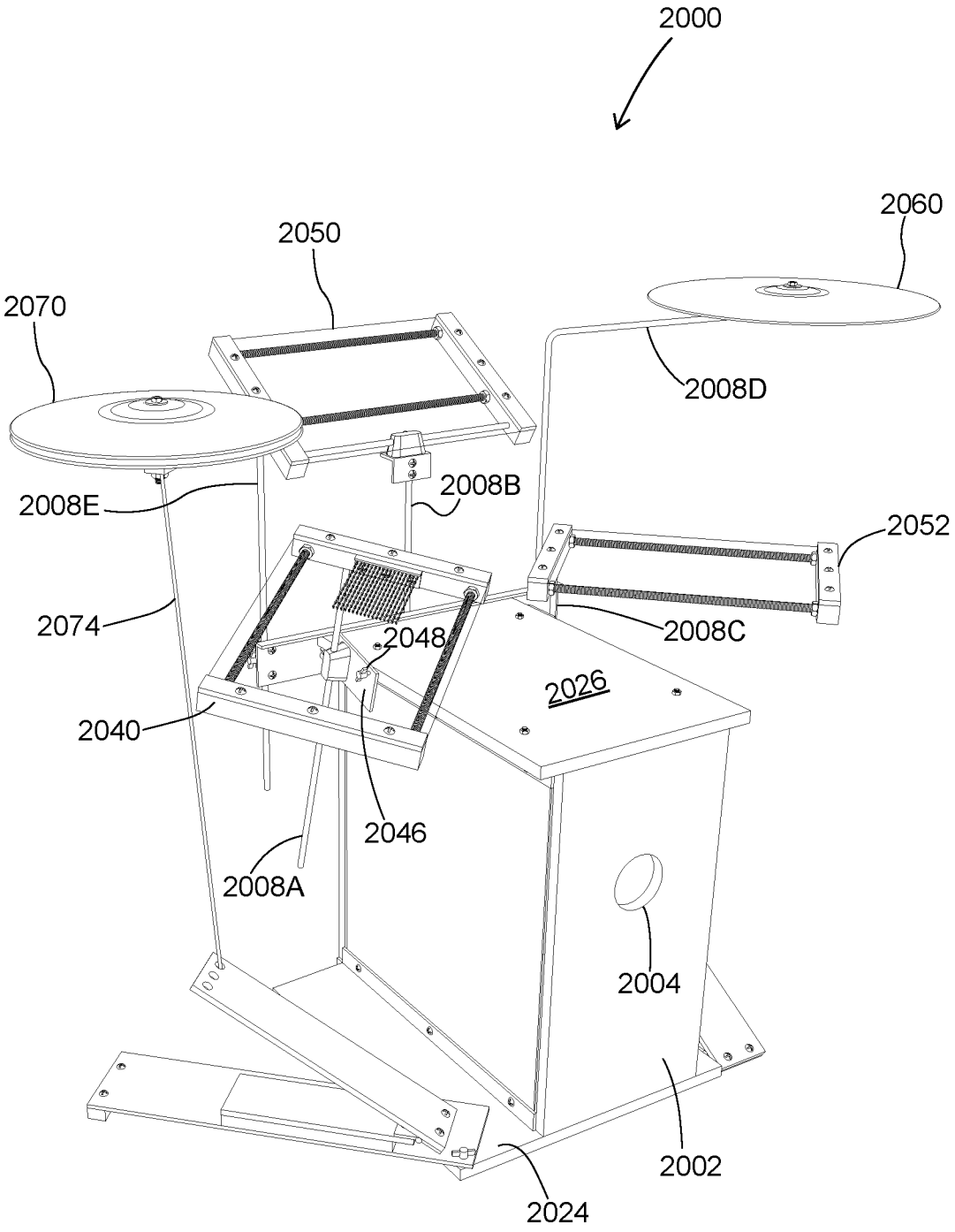
FIG. 20 illustrates a top-front-left perspective view of the exemplary go drum of FIG. 19.
Figure 21:
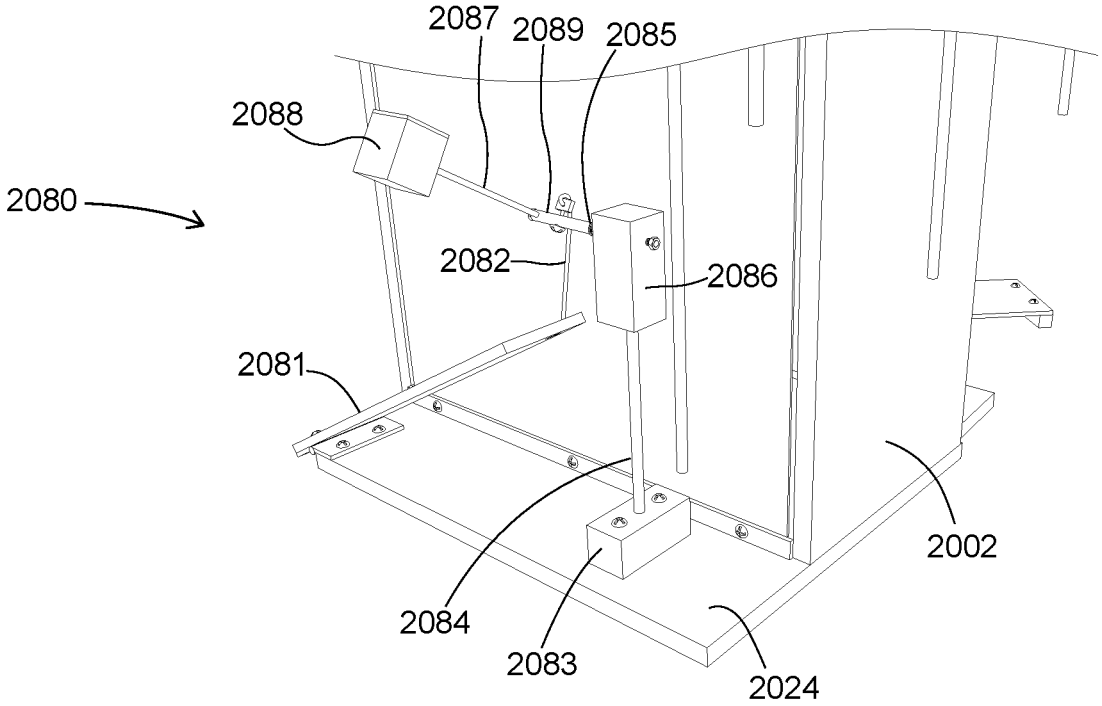
FIG. 21 illustrates a zoomed view of an exemplary drum kick assembly of the exemplary go drum of FIG. 19.
Figure 22:
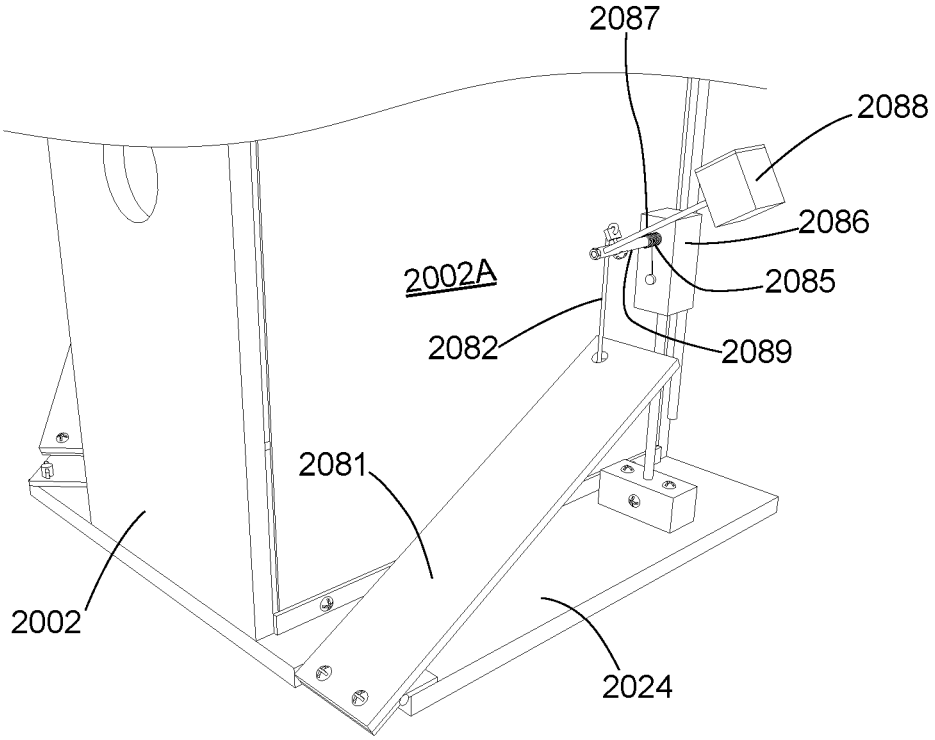
FIG. 22 illustrates another zoomed view of the exemplary drum kick assembly of the exemplary go drum of FIG. 19.

FIGS. 1-4 illustrate a variety of perspective views of an exemplary go drum 2000 that is in a storage position according to the present disclosure. FIGS. 19-20 illustrate a variety of perspective views of the exemplary go drum 2000 that is in an usage position according to the present disclosure. The go drum 2000 includes generally a body (or kick drum) 2002. Body 2002 comprises a hollow interior 2020 and may be defined by a top, a bottom, and three or more sides connecting the top and bottom. Particular embodiments of body 2002 may be a polyhedron of any three dimensional shape, including, but not limited to, a cube, a cylinder that is round or having a top and bottom of any other polygonal shape, a pyramid that is upright or inverted, whole or bisected, having a base comprising a square or any other polygon, and a cone, whole or bisected. In particular embodiments, body 2002 may be a box, crate, case, chest, bongo, polygonal with supporting dome, or any other shape in which it would project a sound like a drum when played. In particular embodiments the sides of body 2002, the sides of the cylinder may be perpendicular to the top and bottom, or the sides may be non-perpendicular, at an angle more or less than 90 degrees to the top and bottom of body 2002.

In particular exemplary embodiments, a platform 2024 is positioned beneath the body 2002. In particular exemplary embodiments, the platform 2024 is sized to cover and extend from the bottom of the body 2002. In particular exemplary embodiments, the bottom of the body 2002 formed a portion of the platform 2024. In particular exemplary embodiments, the bottom of the body 2002 is the platform 2024. Although platform 2024 is shown as a flat plate, platform 2024 may be any suitable form or any shape to facilitate maintaining the body 2002 in a position desirable to be able to play go drum 2000.

In particular exemplary embodiments, a top plate 2026 is positioned above the body 2002. In particular exemplary embodiments, the top plate 2026 is sized to cover and extend from the top of the body 2002. In particular exemplary embodiments, the top of the body 2002 formed a portion of the top plate 2026. In particular exemplary embodiments, the top of the body 2002 is the top plate 2026.

Figure 14:
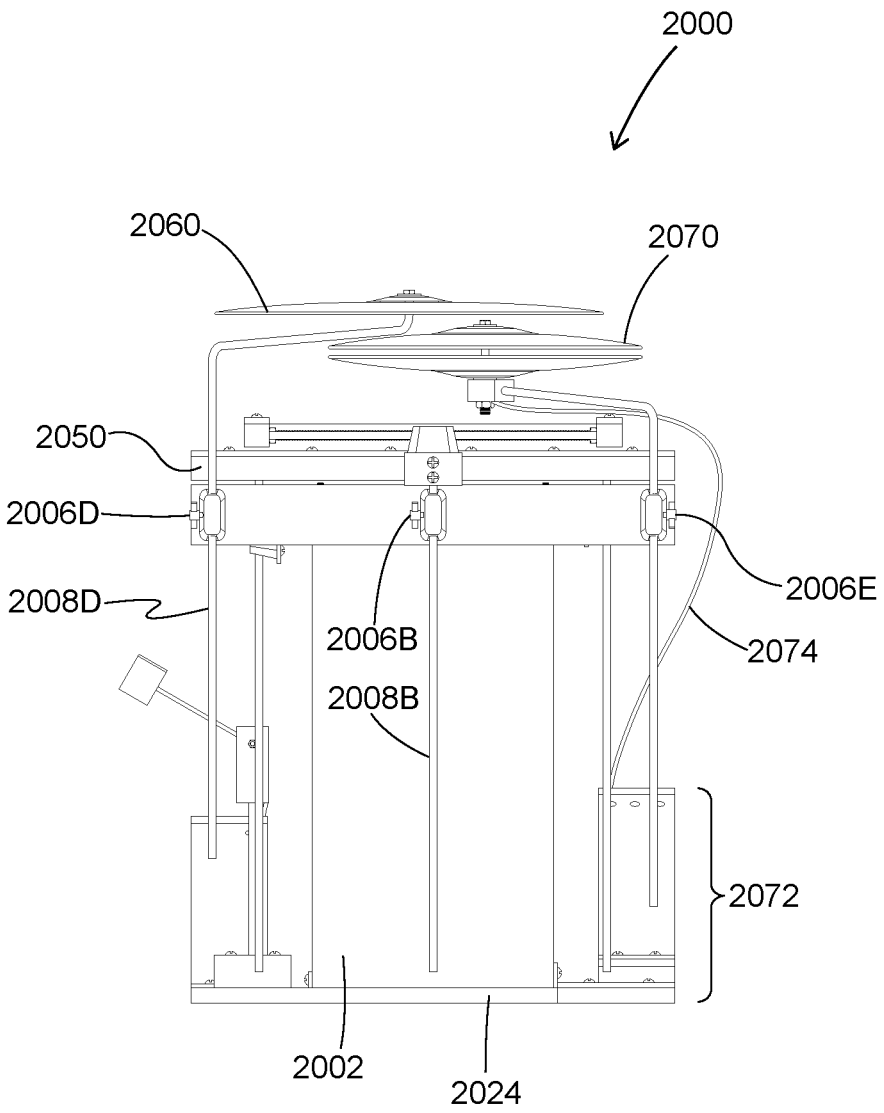
FIG. 14 illustrates a rear view of the exemplary go drum of FIG. 1.

In particular exemplary embodiments, a shaft mounting bracket 2042 is attached to the top plate 2026 for mounting multiple component shafts or component arms 2008B, 2008D, 2008E, which in turn support components 2050, 2060, 2070, respectively. Referring also to FIGS. 14, 20, shaft locking mechanisms 2006B, 2006D, 2006E can be locked and unlocked to allow component shafts 2008B, 2008D, 2008E, respectively, to move up and/or move down freely or to securely fix component shafts 2008B, 2008D, 2008E into a particular position. In particular embodiments, component shaft locking mechanisms 2006B, 2006D, 2006E may allow component shafts 2008B, 2008D, 2008E, respectively, to rotate on its lengthwise axis or remain at a fixed rotation relative to body 2002. In particular exemplary embodiments, shaft mounting bracket 2042 is fixedly attached to the top plate 2026 and not be able to move or rotate relatively to the body 2002.

Figure 16:
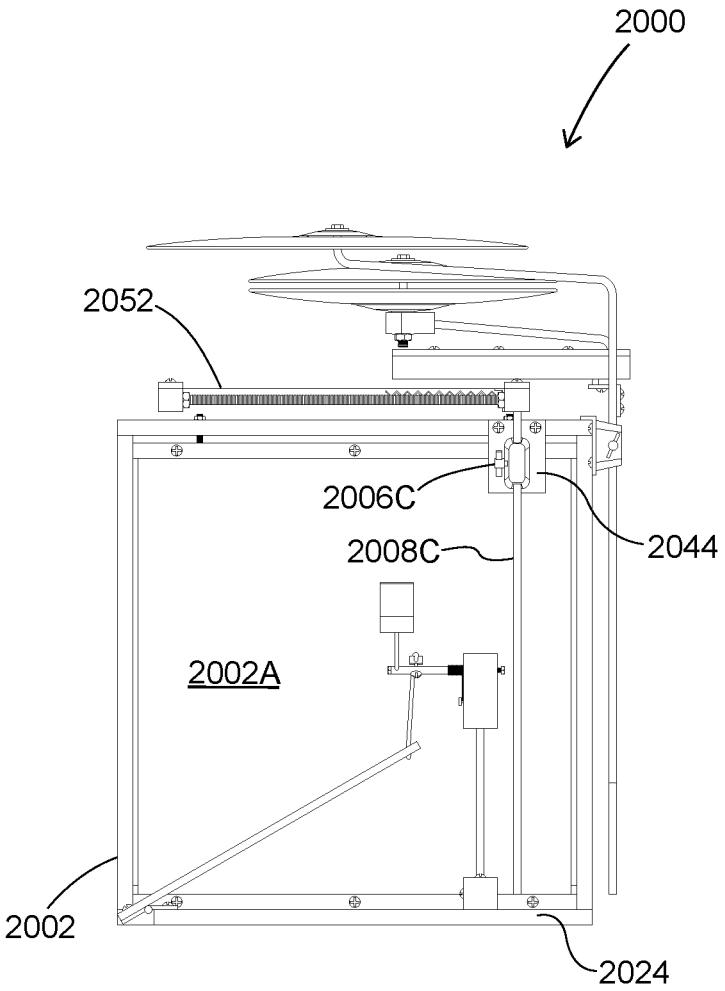
FIG. 16 illustrates a right view of the exemplary go drum of FIG. 1.
Figure 17:
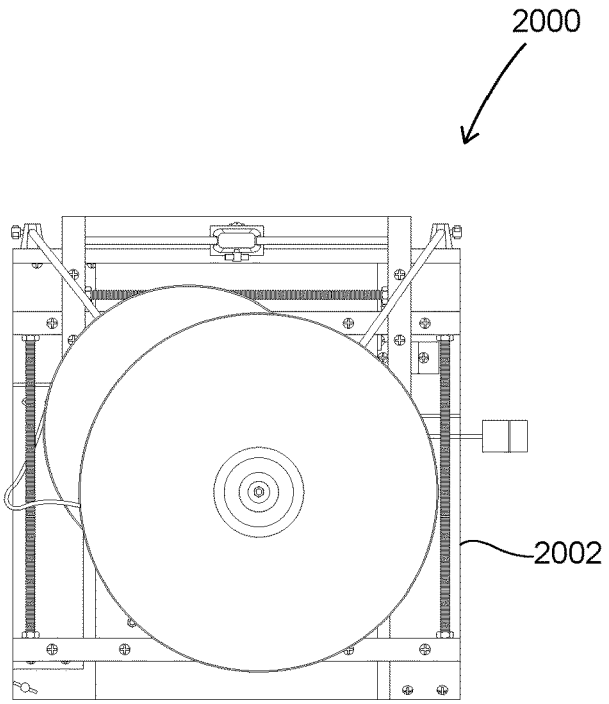
FIG. 17 illustrates a top view of the exemplary go drum of FIG. 1.
Figure 18:
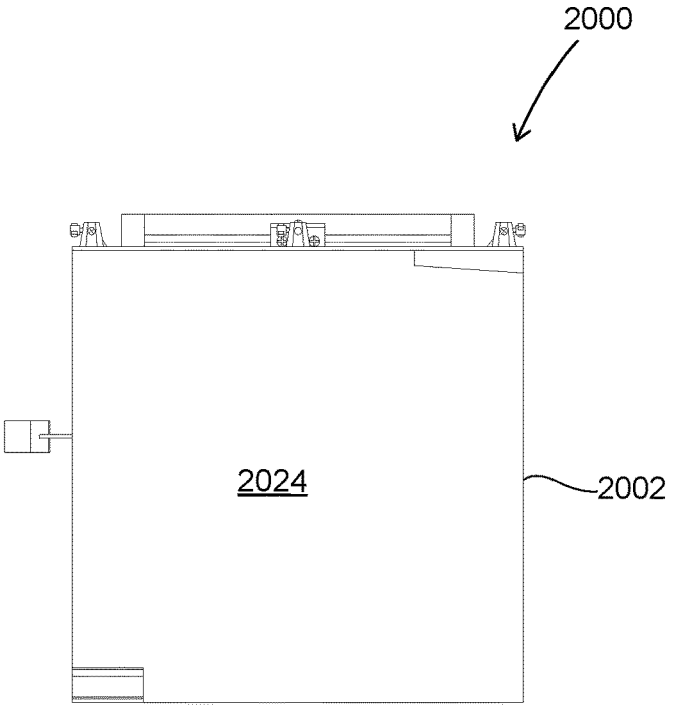
FIG. 18 illustrates a bottom view of the exemplary go drum of FIG. 1.

In particular exemplary embodiments, a shaft mounting bracket 2044 is attached to the top plate 2026 for mounting a component shaft or component arm 2008C which in turn supports a component 2052. Referring also to FIGS. 16, 20, shaft locking mechanism 2006C can be locked and unlocked to allow component shaft 2008C to move up and/or move down freely or to securely fix component shaft 2008C into a particular position. In particular embodiments, component shaft locking mechanism 2006C may allow component shaft 2008C to rotate on its lengthwise axis or remain at a fixed rotation relative to body 2002. In particular exemplary embodiments, shaft mounting bracket 2044 is fixedly attached to the top plate 2026 and not be able to move or rotate relatively to the body 2002.

Figure 15:
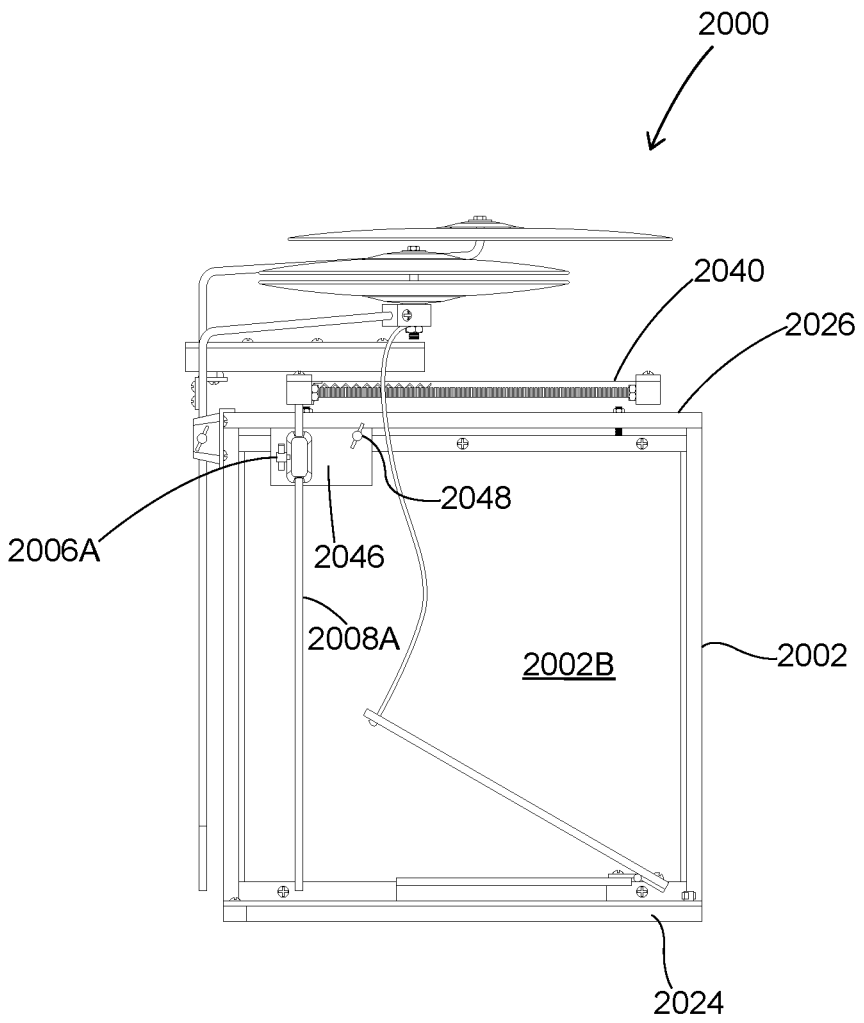
FIG. 15 illustrates a left view of the exemplary go drum of FIG. 1.

In particular exemplary embodiments, a pivot shaft mounting bracket 2046 is attached to the top plate 2026 for mounting a component shaft or component arm 2008A which in turn supports a component 2040. Referring also to FIGS. 15, 20, shaft locking mechanism 2006A can be locked and unlocked to allow component shaft 2008A to move up and/or move down freely or to securely fix component shaft 2008A into a particular position. In particular embodiments, component shaft locking mechanism 2006A may allow component shaft 2008A to rotate on its lengthwise axis or remain at a fixed rotation relative to body 2002.

In particular exemplary embodiments, pivot shaft mounting bracket 2046 is adjustably attached to the top plate 2026 and is able to pivotally rotate relatively to the top plate 2026. In particular exemplary embodiments, pivot shaft mounting bracket 2046 is secured into place by pivot shaft mounting bracket locking mechanism 2048. Pivot shaft mounting bracket locking mechanism 2048 can be locked and unlocked to allow pivot shaft mounting bracket 2046 to rotate freely relative to an axis perpendicular to a longitudinal direction of the pivot shaft mounting bracket 2046 or to securely fix pivot shaft mounting bracket 2046 into a particular position. Although pivot shaft mounting bracket locking mechanism 2048 is shown as a thumb screw or a wing screw, pivot shaft mounting bracket locking mechanism 2048 may be any suitable locking mechanisms. With the configurations described herein, the angle of the head of the component 2040 may be adjusted.

Body 2002, platform 2024 and top plate 2026 may be made of any suitable material, including but not limited to wood, carbon fiber, fiber glass, metal, plastic, and the like. Mounting bracket 2042, mounting bracket 2044 and pivot mounting bracket 2046 may be made of any suitable material, including but not limited to wood, carbon fiber, fiber glass, metal, plastic, and the like.

In particular exemplary embodiments, there are a number of features of body 2002 to enable body 2002 to behave as a drum. In particular embodiments, body 2002 may have a sound hole 2004 on a side of body 2002 from which sound emanates depending on whether the top or another side of the body 2002 is struck.

Figure 1:
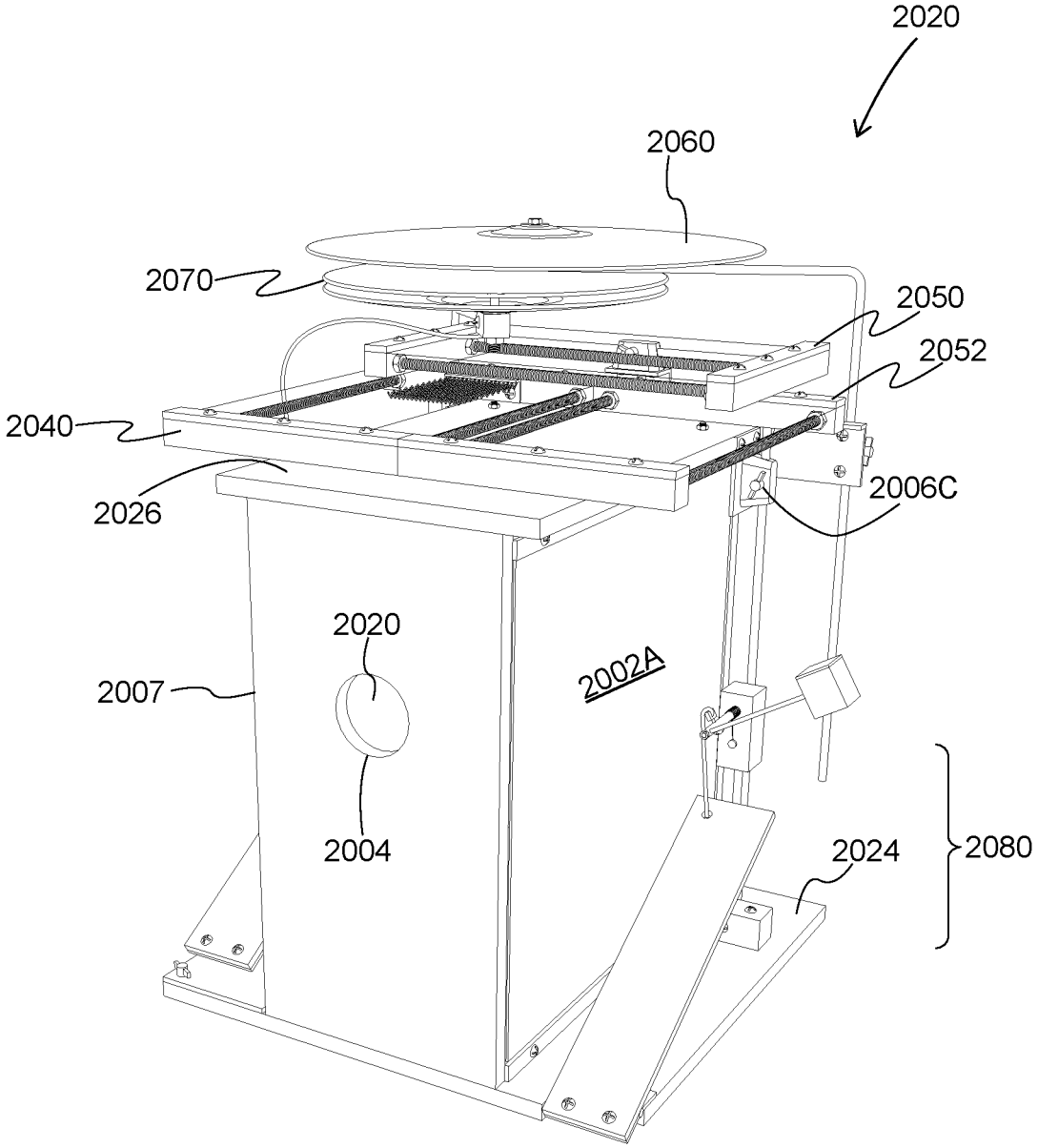
FIG. 1 illustrates a top-front-right perspective view of an exemplary go drum that is in a storage position.
Figure 2:
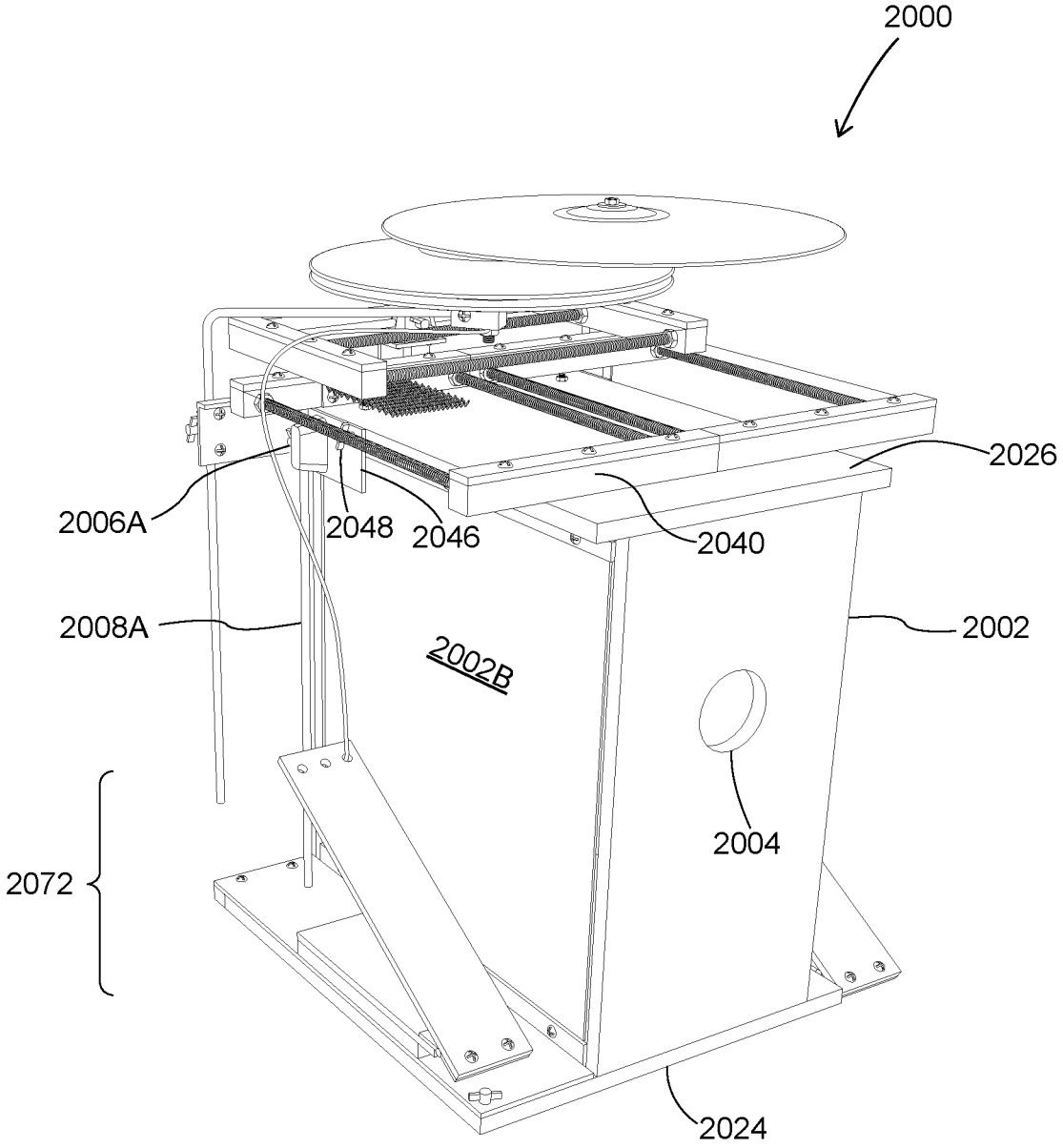
FIG. 2 illustrates a top-front-left perspective view of the exemplary go drum of FIG. 1.
Figure 4:
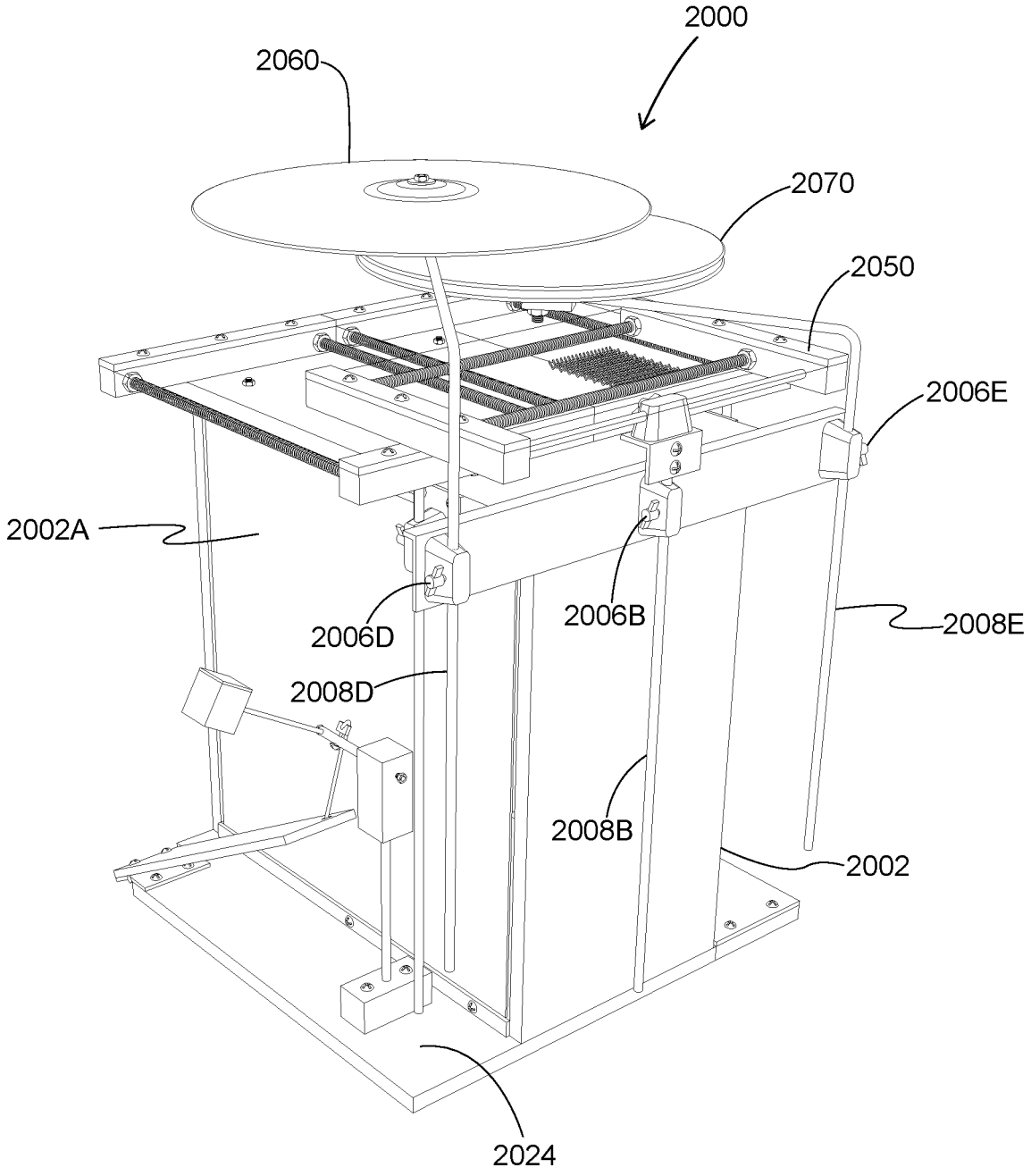
FIG. 4 illustrates a top-rear-right perspective view of the exemplary go drum of FIG. 1.
Figure 5:
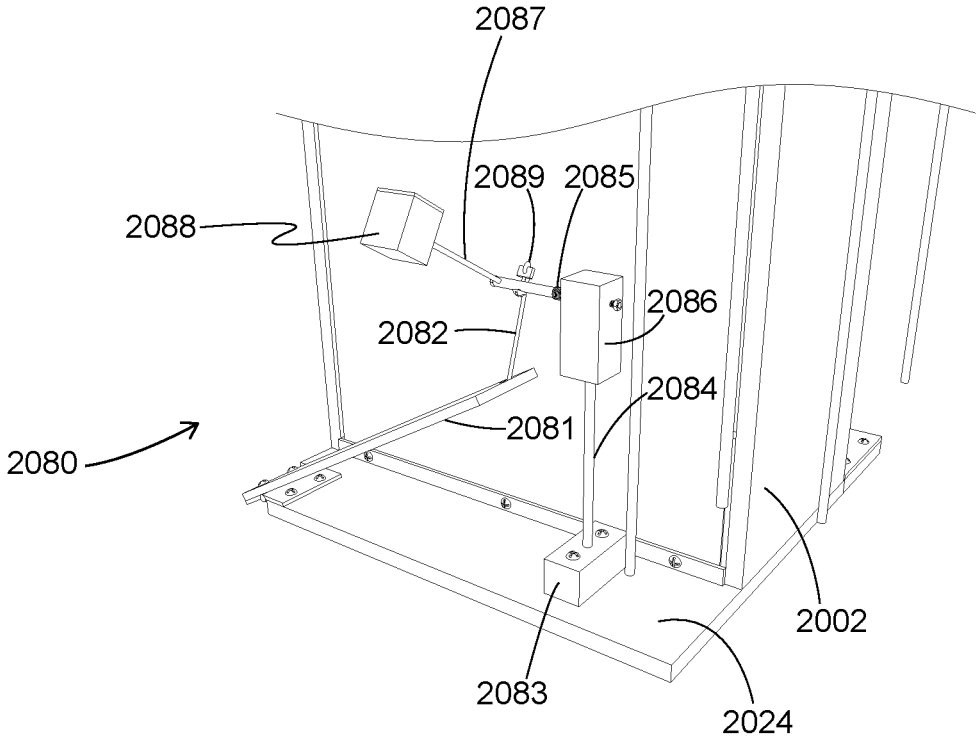
FIG. 5 illustrates a zoomed view of an exemplary drum kick assembly of the exemplary go drum of FIG. 1.
Figure 6:
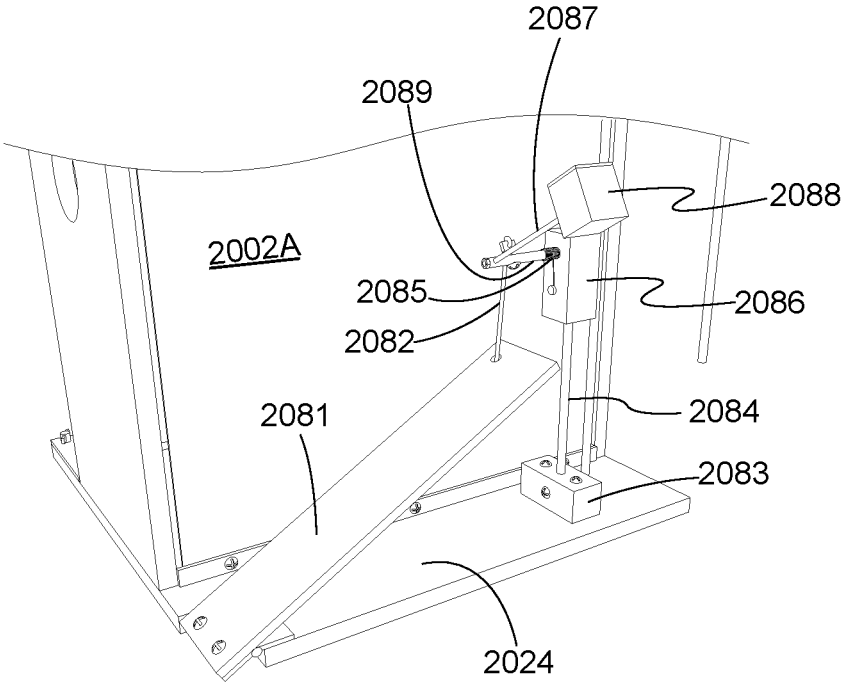
FIG. 6 illustrates another zoomed view of the exemplary drum kick assembly of FIG. 5.
Figure 7:
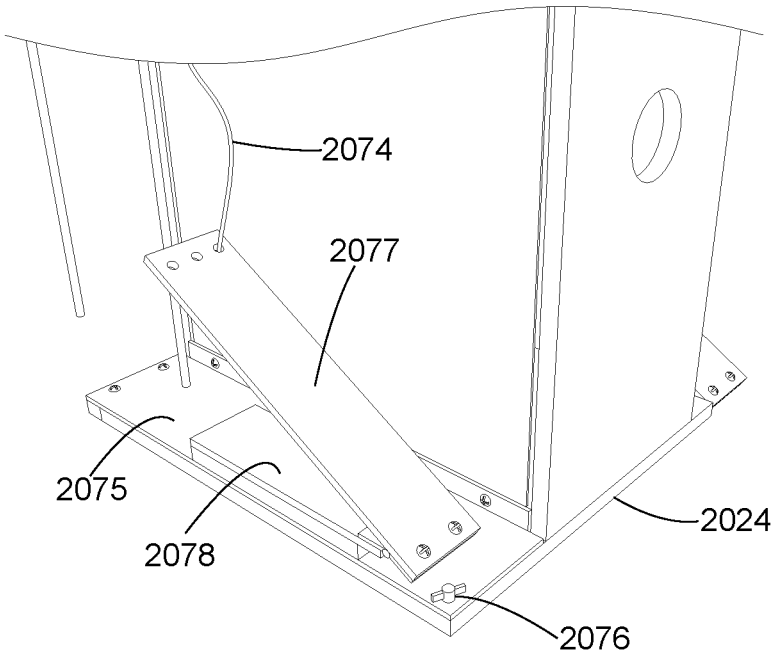
FIG. 7 illustrates a zoomed view of an exemplary hi-hat pedal assembly of the exemplary go drum of FIG. 1.
Figure 8:
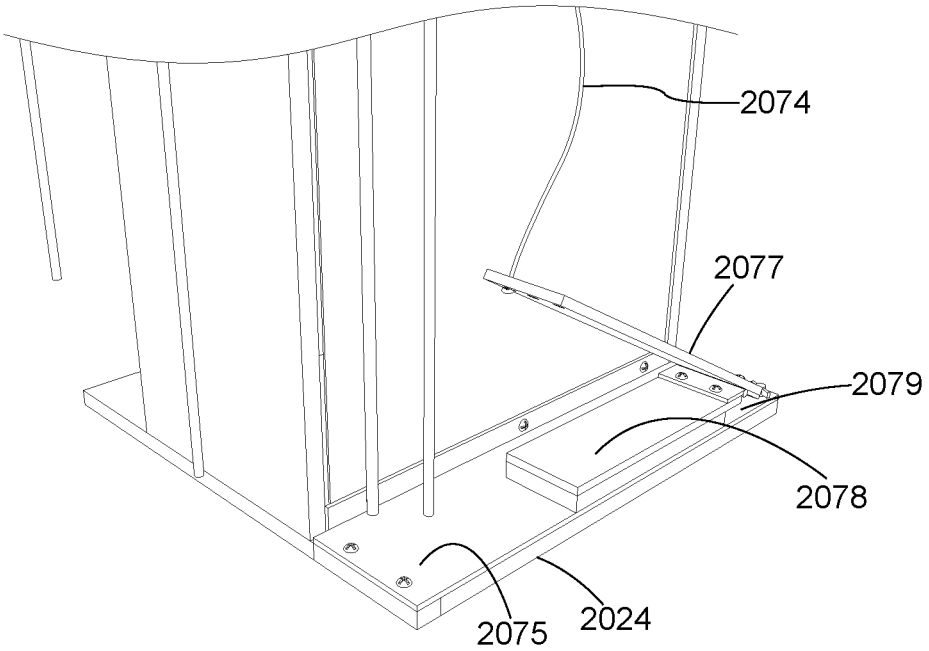
FIG. 8 illustrates another zoomed view of the exemplary hi-hat pedal assembly of FIG. 7.
Figure 9:
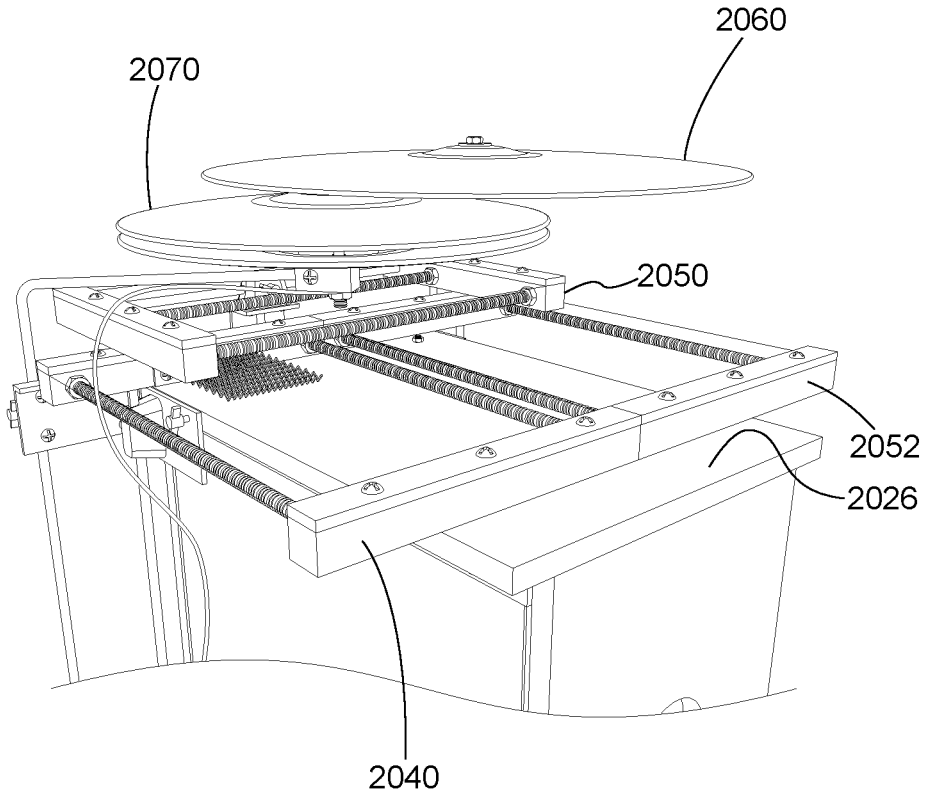
FIG. 9 illustrates a zoomed view of exemplary components of the exemplary go drum of FIG. 1.
Figure 10:
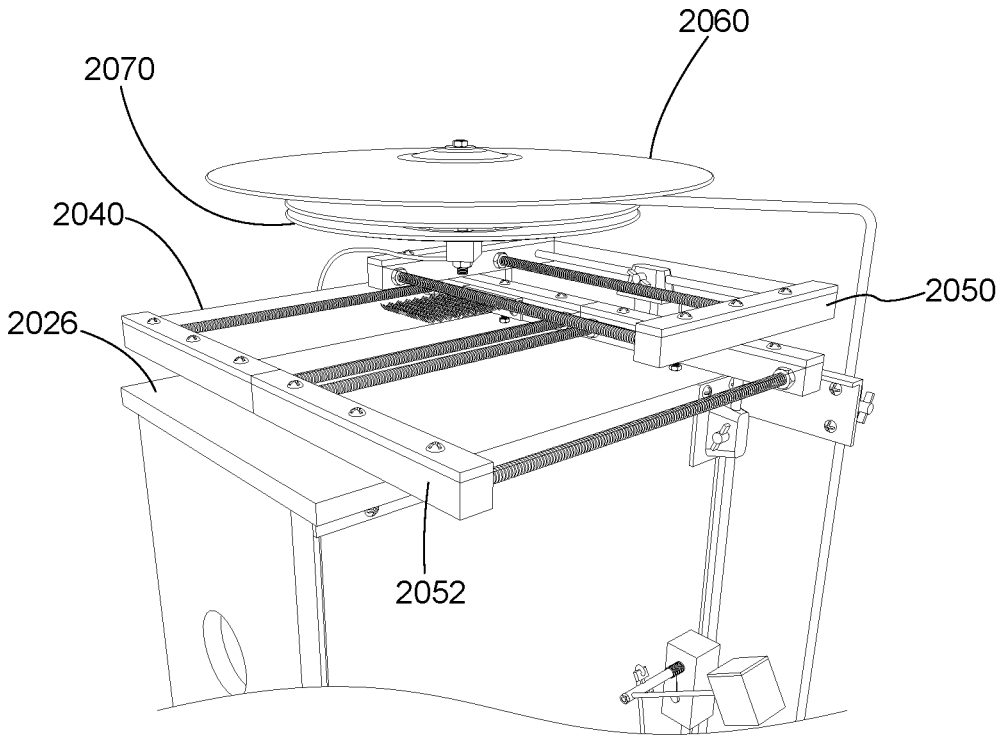
FIG. 10 illustrates another zoomed view of exemplary components of the exemplary go drum of FIG. 1.
Figure 11:
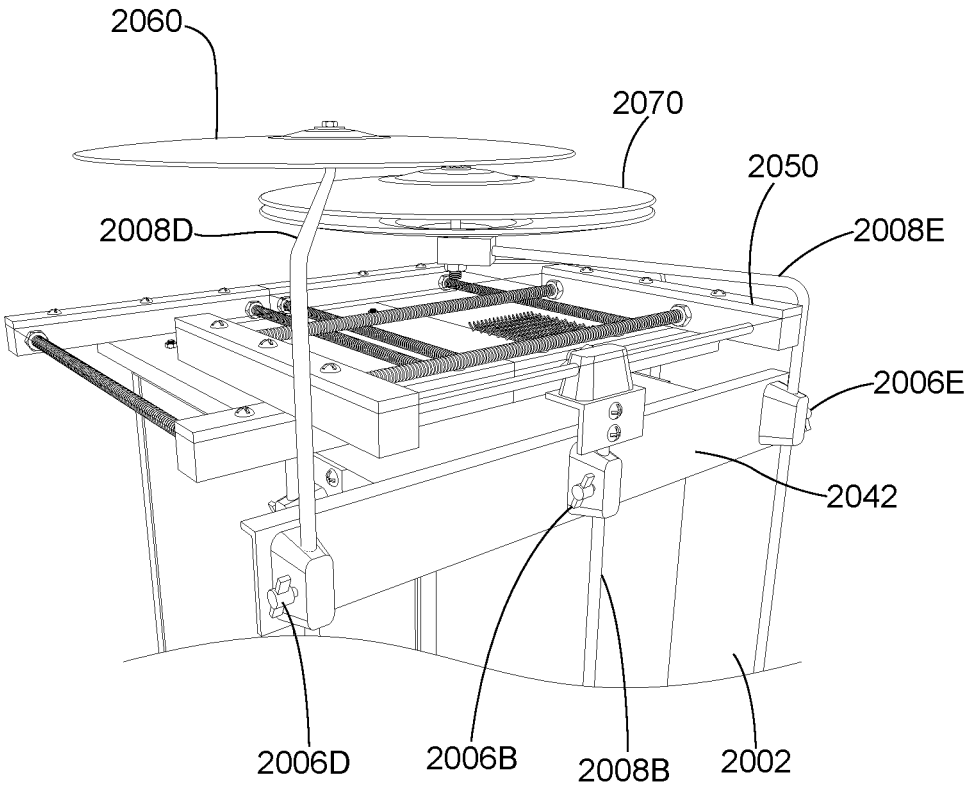
FIG. 11 illustrates another zoomed view of exemplary components of the exemplary go drum of FIG. 1.
Figure 12:
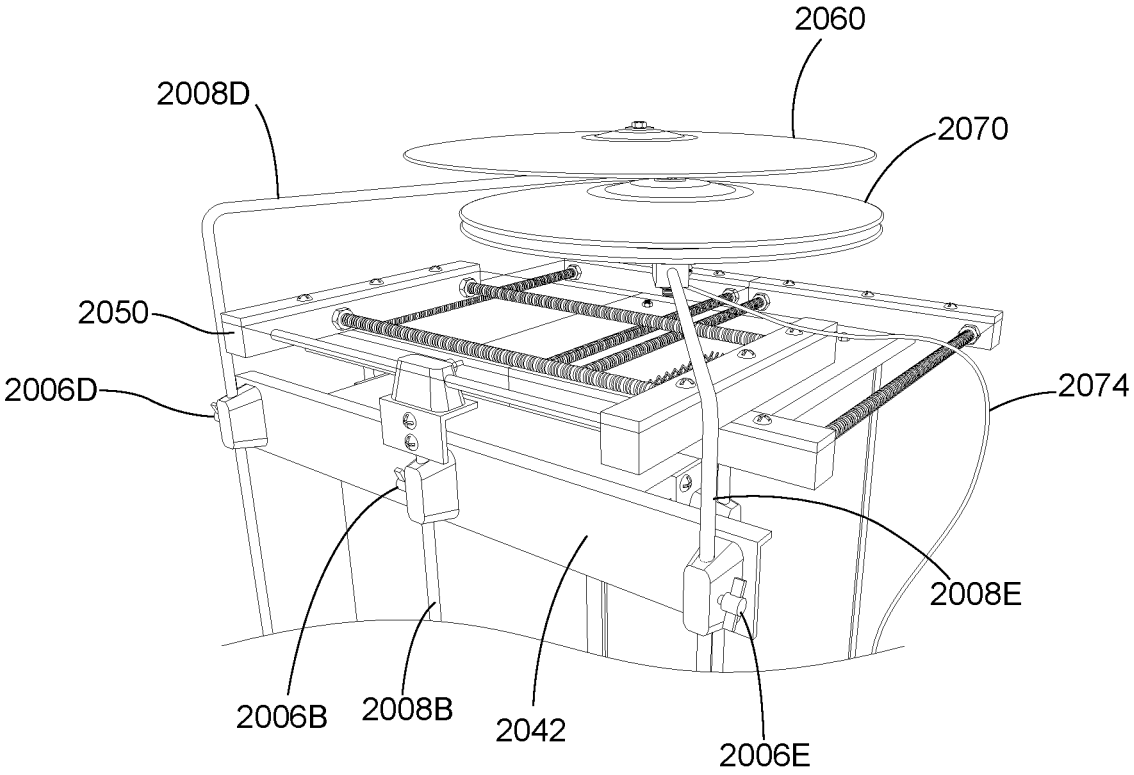
FIG. 12 illustrates another zoomed view of exemplary components of the exemplary go drum of FIG. 1.
Figure 13:
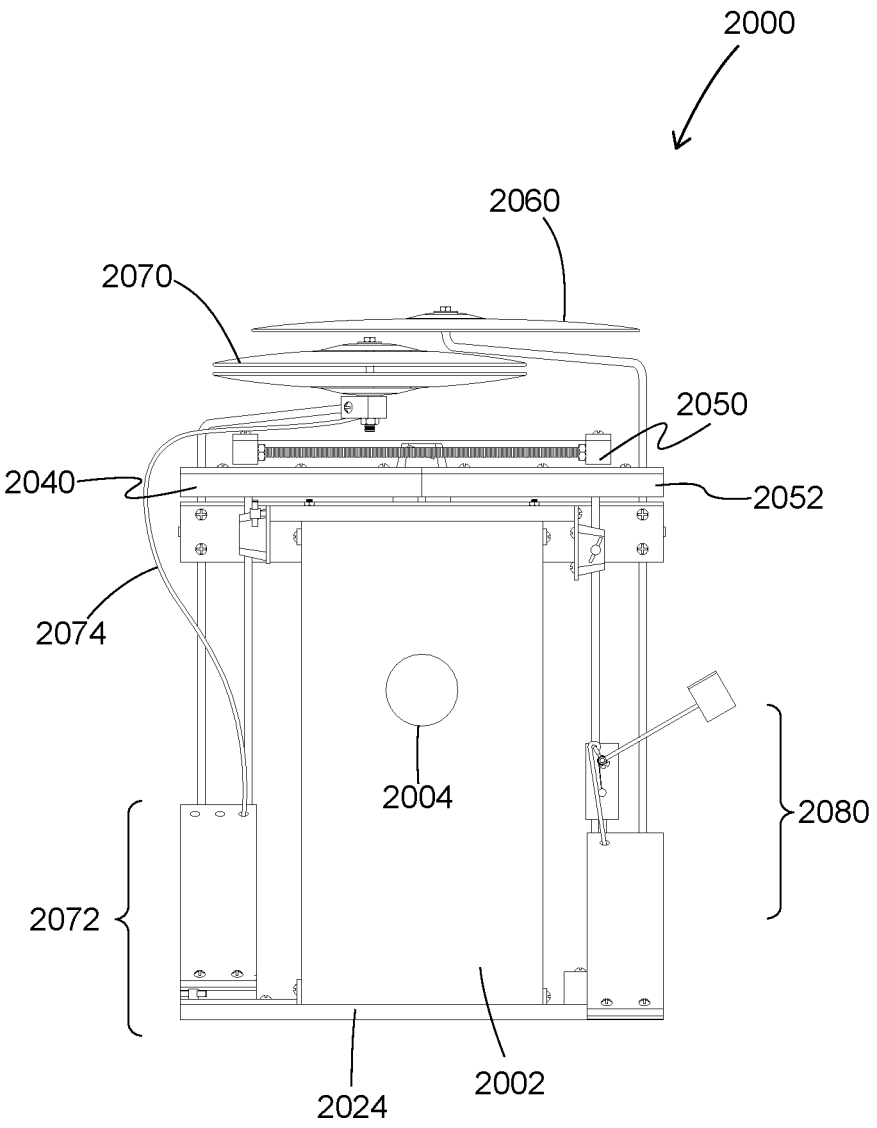
FIG. 13 illustrates a front view of the exemplary go drum of FIG. 1.

As is shown in FIGS. 1, 4, kick drum 2002 has a striking side or striking head 2002A that may be struck by a beater 2088 of a drum kick assembly 2080. When beater 2088 strikes striking head 2002A, it creates oscillations on the striking head 2002A and sound waves carrying corresponding frequencies would travel through sound hole 2004. In particular embodiments, striking head 2002A may comprise any shape, including but not limited to a rectangle, square or other polygon having a plurality of sides. In particular embodiments, striking head 2002A may be comprised of the same material as body 2002. In particular embodiments, striking head 2002A may be comprised of mylar. In particular embodiments, striking head 2002A may be tunable. In particular embodiments, striking head 2002A can be tuned by means of one or more tension rods that run substantially the whole length of one side of the striking head 2002A.

Alternatively, striking head 2002A can be tuned by means of one or more tension bolts that protrude a portion along a side of the surface of the striking head 2002A. In particular embodiments, striking head 2002A may be tunable and comprised of mylar.

Figure 3:
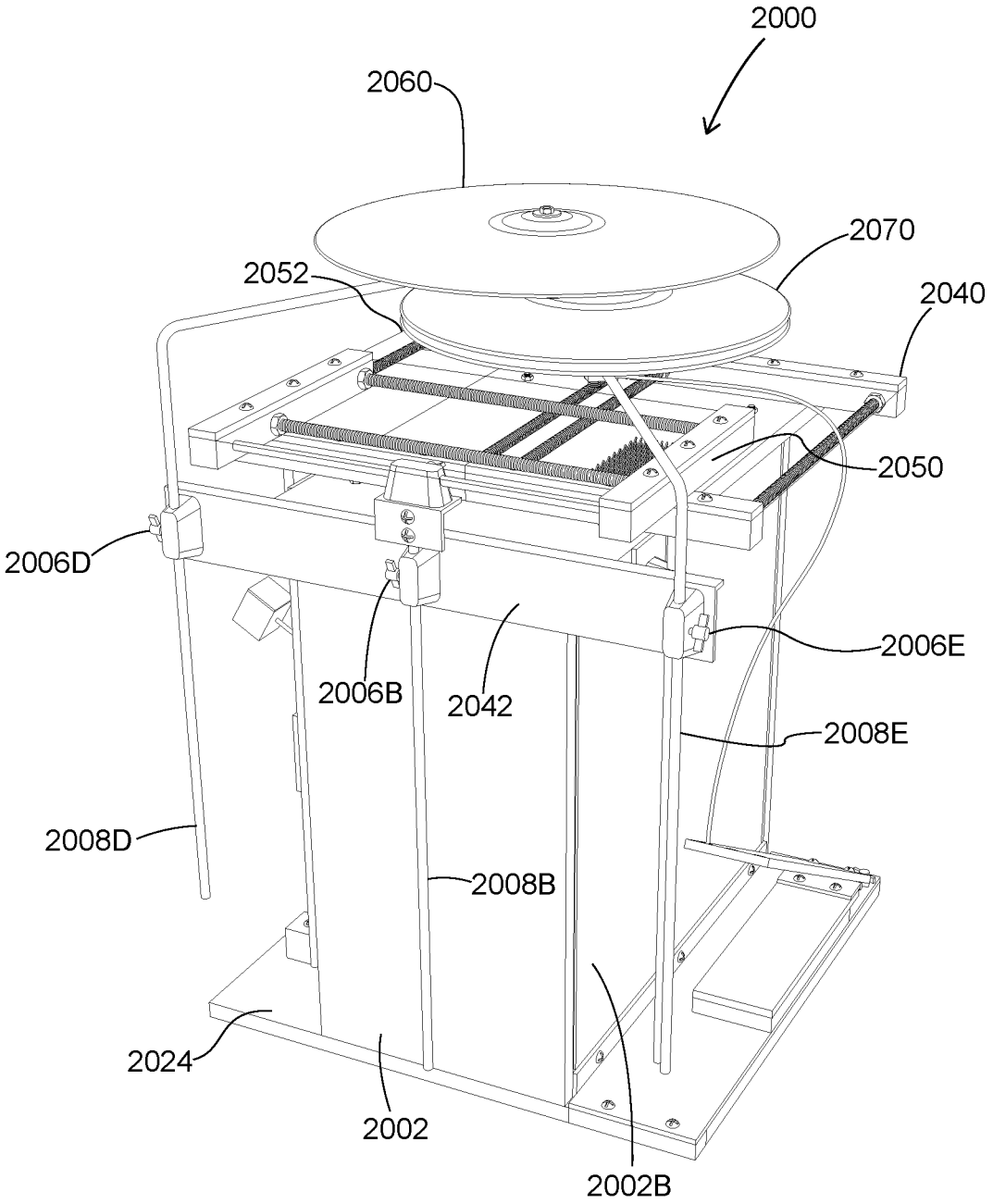
FIG. 3 illustrates a top-rear-left perspective view of the exemplary go drum of FIG. 1.

As is shown in FIG. 3, kick drum 2002 has a resonant side or resonant head 2002B that is positioned on the opposite side of the striking side 2002A. When beater 2088 strikes striking head 2002A, sound waves carrying resonant frequencies due to oscillations of the resonant head 2002B would travel through sound hole 2004. In particular embodiments, resonant head 2002B is comprised of the same dimension and the same material as striking head 2002A to generate corresponding resonant frequency. In particular embodiments, resonant head 2002B may be comprised of mylar. In particular embodiments, resonant head 2002B may be tunable. In particular embodiments, resonant head 2002B can be tuned by means of one or more tension rods that run substantially the whole length of one side of the resonant head 2002B. Alternatively, resonant head 2002B can be tuned by means of one or more tension bolts that protrude a portion along a side of the surface of the resonant head 2002B. In particular embodiments, resonant head 2002B may be tunable and comprised of mylar.

The top of body 2002 has a top component 2040 that may be struck. When top component 2040 is struck, sound also travels through sound hole 2004. Although in particular embodiments go drum 2000 has a sound hole 2004 on a particular side of body 2002, a sound hole may be located on any side of go drum 2000. In particular embodiments, go drum 2000 may have no sound hole at all or may have any number of sound holes more than one sound hole. In particular embodiments, a sound hole may comprise any size from very small to an entire side or the bottom of body 2002 may be open and functionally behave as a sound hole.

In particular exemplary embodiments, each of the component shafts or arms 2008A-2008E is supported by one of the mounting brackets 2042, 2044, 2046. In particular embodiments, there may be more or less component shafts depending on the number of desired components for a particular go drum 2000. Component shafts 2008A-2008E are secured into place by component shaft locking mechanisms 2006A-2006E, respectively. Each of the component shaft locking mechanisms 2006A-2006E locks and unlocks to allow corresponding component shafts 2008A-2008E to move up and/or move down freely or to securely fix component shafts 2008A-2008E into a particular position. In particular embodiments, each of the component shaft locking mechanisms 2006A-2006E may allow corresponding component shafts 2008A-2008E to rotate on its lengthwise axis or remain at a fixed rotation relative to body 2002.

In particular embodiments, component shafts 2008A-2008E can be lowered and rotated so that corresponding components 2040, 2050, 2052, 2060, 2070 can be placed at positions for storage and/or transportation as shown in FIGS. 1-4. In particular embodiments, component shafts 2008A-2008E can be raised and rotated so that corresponding components 2040, 2050, 2052, 2060, 2070 can be placed at positions for usage, e.g., practice, performance, etc., as shown in FIGS. 19-20.

In the example embodiments illustrated in the figures, each of the component shafts 2008A-2008E is straight for at least a portion of its length. The straight portion of each of the component shafts 2008A-2008E is primarily so that component shafts may be locked at various heights from storage and/or transport position as shown in FIGS. 1-4 to fully extended the full length of component shafts for usage position as shown in FIGS. 19-20, such that it may still be locked into place with corresponding component shaft locking mechanisms 2006A-2006E. In particular embodiments, component shafts 2008A-2008C may be entirely straight as shown in along its length or any other shape along its length facilitate fastening components to the outside of the body 2002.

In the example embodiments illustrated in the figures, each of component shafts 2008D-2008E is curved for another portion of its length. In particular embodiments, the curved portion of component shafts 2008D-2008E may be curved in the shape of an "L", or at any other degree or angle in which to allow each of the corresponding components to be extended away and fastened above body 2002.

Component shafts 2008D-2008E may be smooth, knurled, or spline. In particular embodiments, a portion of component shafts 2008D-2008E may be smooth and another portion of component shafts 2008D-2008E may be knurled. In particular embodiments, component shafts 2008D-2008E may be smooth, knurled, or spline in its entirety. In particular embodiments, component shafts 2008D-2008E may be solid or hollow. In particular embodiments. component shafts 2008D-2008E may be made of any suitable material, including but not limited to wood, carbon fiber, fiberglass, metal, or plastic.

Although component shaft locking mechanisms 2006A-2006E are shown as a thumb screw or a wing screw, component shaft locking mechanisms 2006A-2006E may be any suitable locking mechanisms.

As is shown in the figures, various components 2040, 2050, 2052, 2060, 2070 are attached to various component shafts 2008A-2008E, respectively. In particular embodiments, components 2040, 2050, 2052, 2060, 2070 are removably attached to component shafts 2008A-2008E, respectively. Alternatively, components 2040, 2050, 2052, 2060, 2070 are attached to component shafts 2008A-2008E, respectively, by collar lock, thereby fixing the components in place. In particular embodiments, each of the components 2040, 2050, 2052, 2060, 2070 are sit on top of corresponding component shafts 2008A-2008E, respectively. Although particular components 2040, 2050, 2052, 2060, 2070 are shown attached to specific component shafts 2008A-2008E, respectively, it is understood by one in the art that each of the components may be attached to different component shafts in different configurations.

Referring also to FIGS. 9-18, which illustrate a variety of views of the exemplary go drum 2000. In particular embodiments, component 2040 can be a snare drum. Snare drum 2040 has a snare head for accepting striking and an opposing lower skin. In particular embodiments, snare drum 2040 may have a frame comprising any shape, including but not limited to a square, rectangle, circle, or other polygon having a plurality of sides. In particular embodiments, snare drum 2040 comprises a series of stiff wires held under tension against the lower skin of the snare drum 2040. In particular embodiments, snare drum 2040 may be independent of body 2002 and merely be placed on the top of body 2002. In particular embodiments, snare drum 2040 may be integrated into the top plate 2026, where the top plate 2026 comprises a frame surrounding the strikable surface of snare drum 2040. In particular embodiments, the top plate 2026 may itself be snare drum 2040. In particular embodiments, snare drum 2040 may be composed of mylar. In particular embodiments, snare drum 2040 may be tunable. In particular embodiments, snare drum 2040 is tuned by means of one or more rods. In particular embodiments, snare drum 2040 may be tunable and comprised of mylar.

As is shown in the figures, each of components 2050, 2052 are fixed atop component shafts 2008B, 2008C, respectively. In particular exemplary embodiments, components 2050, 2052 may be one or more tom-tom drums. In particular embodiments, components 2050, 2052 may be a typical tom-tom drums, including a high tom 2050 and a low tom 2052. Each of the tom-tom drums 2050, 2052 may comprise a cylindrical drum with no snares comprising a shell, a rim, and a head. In particular exemplary embodiments, each of the components 2050, 2052 is a tom-tom comprising a frame and a head. In particular embodiments, each of the tom-tom drums 2050, 2052 has a head comprising mylar. In particular embodiments, each of the tom-tom drums 2050, 2052 may be a different size and pitch, such as hi, mid, or low. In particular embodiments, each of the tom-tom drums 2050, 2052 may have a frame comprising any shape, including but not limited to a square, rectangle, circle, or other polygon having a plurality of sides. In particular embodiments, each of the tom-tom drums 2050, 2052 may be adjustable so that it may tuned to project sounds of different pitch. In particular embodiments, tom-tom drums 2050, 2052 can be tuned by means of one or more tension rods.

As is shown in the figures, component 2060 is fixed atop a component shaft 2008D. In particular exemplary embodiments, component 2060 may be a cymbal. In particular embodiments, component 2060 may be one or more cymbals. In particular embodiments, component 2060 may be a crash, ride, or crash/ride cymbal.

As is shown in the figures, component 2070 is fixed atop a component shaft 2008E. In particular exemplary embodiments, component 2070 may be a pair of hi-hat cymbals.

Referring also to FIGS. 7-8 and 23-26, hi-hat pedal assembly 2072 is shown to the left of body 2002 so that a left foot of a drummer may operate hi hat pedal assembly 2072 and pulling connector 2074, thus, causing component 2070 to project sound. In particular embodiments, pulling connector 2074 may be a string, rope, cable or wire that is inelastic or elastic or sinewy material.

As is shown in the figures, hi-hat pedal assembly 2072 comprises a number of parts, including footboard 2077, base plate 2078 and connector 2079. In particular embodiments, connector 2079 may be a heel hinge, such as a heel hinge that connects footboard 2077 and base plate 2078. In particular embodiments, pulling connector 2074 is attached to footboard 2077 opposite to connector 2074. In particular embodiments, hi-hat pedal assembly 2072 is mounted to the platform 2024.

As is shown in the figures, a pivot plate 2075 may be pivotally mounted to the platform 2024 according to some embodiments. In particular embodiments, pivot plate 2075 can be mounted to the platform 2024 through a wing screw 2076 that the pivot plate 2075 can swivel away from the platform 2024. In other embodiments, pivot plate 2075 can be mounted to the platform 2024 by other means.

In particular exemplary embodiments, pivot plate 2075 is secured into place by pivot plate locking mechanism 2076. Pivot plate locking mechanism 2076 can be unlocked to allow plate 2075 to swivel away from and toward relative to the platform 2024 or can be locked to securely fix pivot plate 2075 into a particular position. Although pivot plate locking mechanism 2076 is shown as a thumb screw or a wing screw, pivot plate locking mechanism 2076 may be any suitable locking mechanisms. Pivot plate 2075 can be made of metal according to some embodiments.

As is shown in the figures, hi-hat pedal assembly 2072 (including footboard 2077, base plate 2078 and connector 2079) is mounted on the pivot plate 2075 according to some embodiments. In some embodiments, hi-hat pedal assembly 2072 is magnetically mounted on the pivot plate 2075. In this regard, hi-hat pedal assembly 2072 can be mounted on the pivot plate 2075 with a variety of locations and/or positions with a variety of directions by disengaging/engaging the magnetic connection between the hi-hat pedal assembly 2072 and the pivot plate 2075. Base plate 2078 can be made of a magnetic material according to some embodiments.

Figure 23:
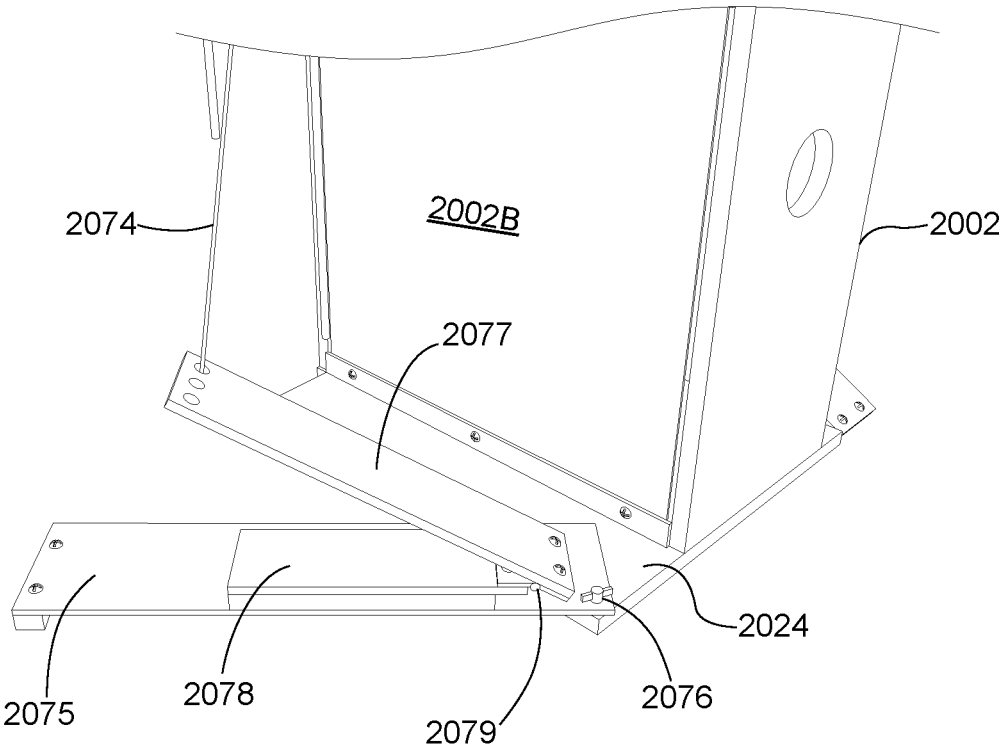
FIG. 23 illustrates a zoomed view of an exemplary hi-hat pedal assembly of the exemplary go drum of FIG. 19.
Figure 24:
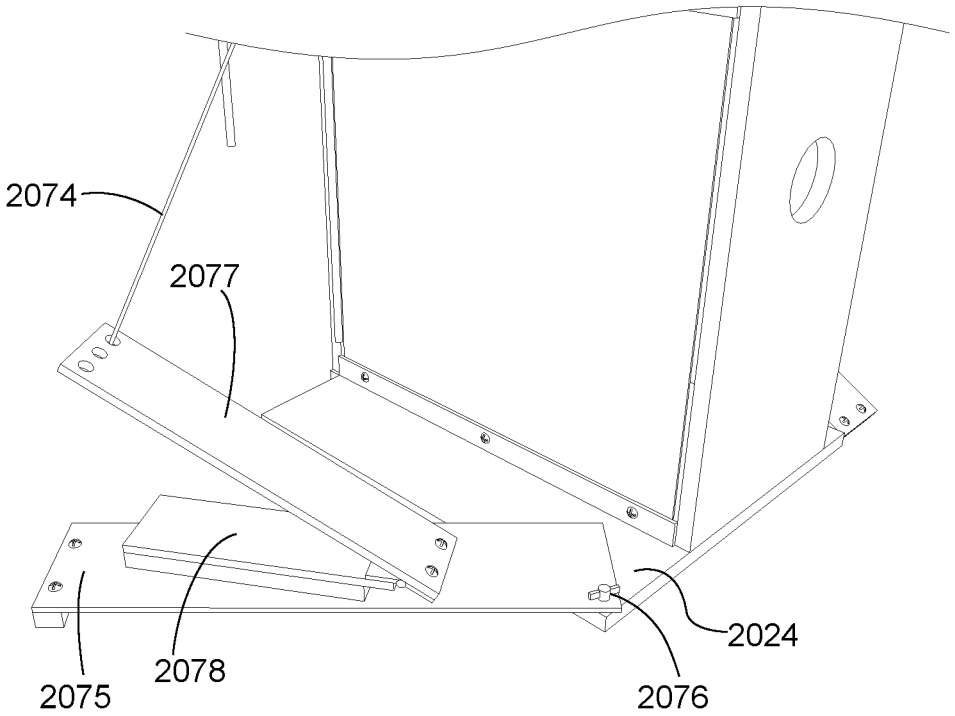
FIG. 24 illustrates another zoomed view of the exemplary hi-hat pedal assembly of the exemplary go drum of FIG. 7.
Figure 25:
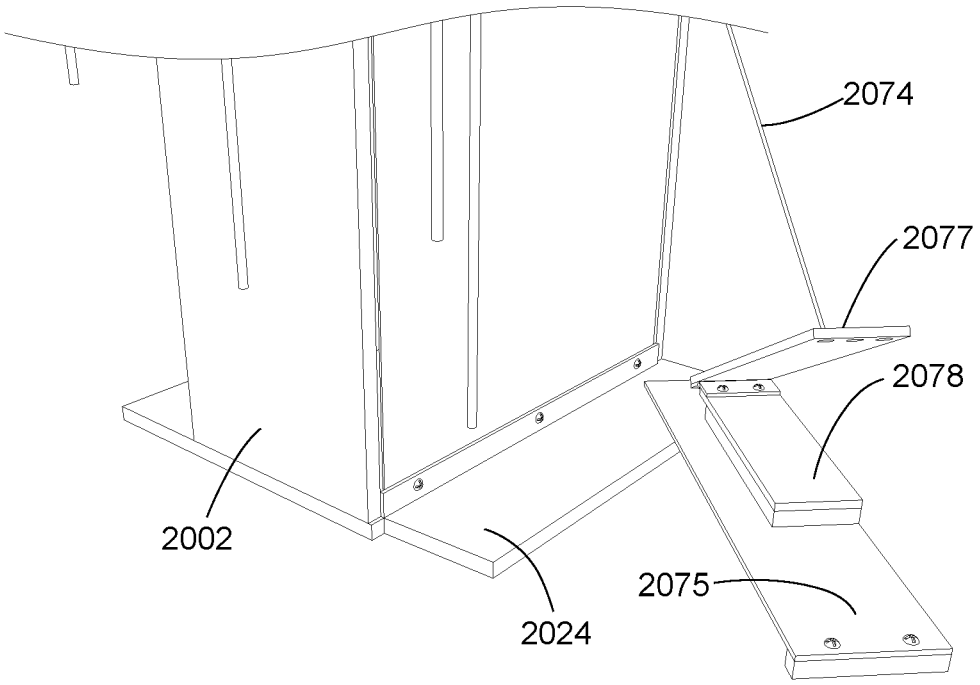
FIG. 25 illustrates another zoomed view of the exemplary hi-hat pedal assembly of the exemplary go drum of FIG. 7.
Figure 26:
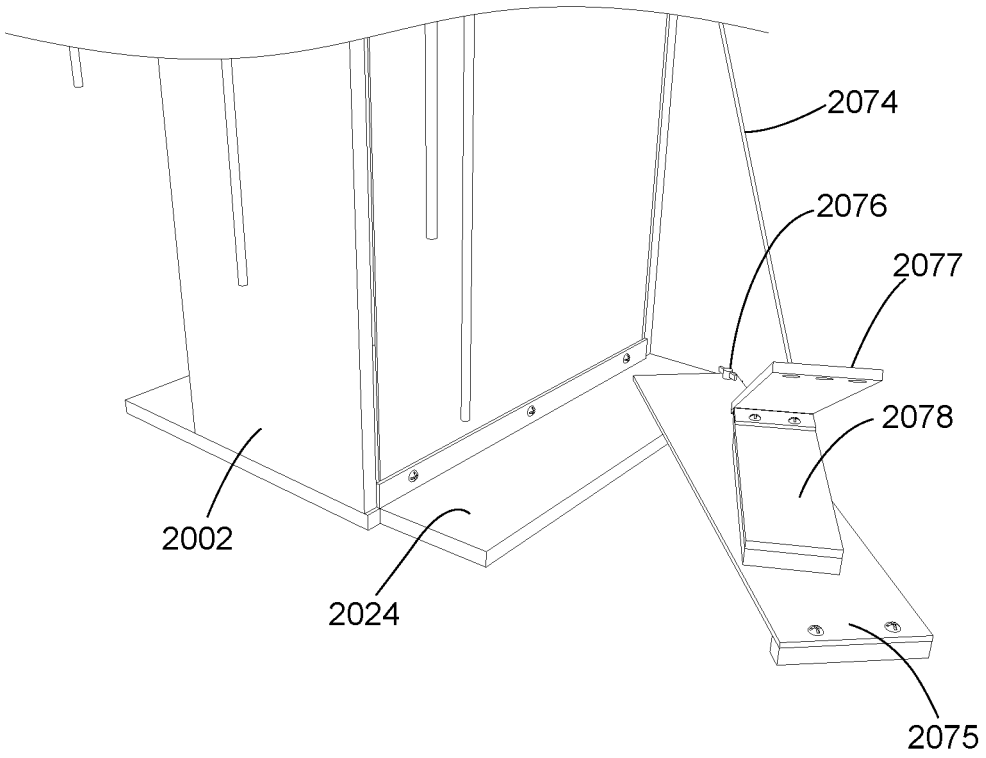
FIG. 26 illustrates another zoomed view of the exemplary hi-hat pedal assembly of the exemplary go drum of FIG. 7.

Comparing the different positions of the hi-hat pedal assembly 2072 relatively to the pivot plate 2075 between FIG. 23 and FIG. 24 and between FIG. 25 and FIG. 26, an angle formed by the longitudinal direction of the hi-hat pedal assembly 2072 and a side of the platform 2024 can varies by adjusting the hi-hat pedal assembly 2072 relatively to the pivot plate 2075. With the configurations provided, hi-hat pedal assembly 2072 can have a variety of angles relative to the drummer. In addition, hi-hat pedal assembly 2072 can have various distance away from the platform 2024.

Referring also to FIGS. 5-6 and 21-22, drum kick assembly 2080 is positioned to the right of body 2002 so that a right foot of a drummer may operate drum kick assembly 2080. In particular exemplary embodiments, drum kick assembly 2080 comprises a number of parts, including a drum pedal 2081, a pedal rod 2082, a kick pedal bar 2083, a beater mount 2084, a spring 2085, a connector 2086, a beater extension 2087, a beater 2088, and a connector rod 2089. In particular embodiments, drum kick assembly 2080 is mounted on the platform 2024.

In particular embodiments, drum pedal 2081 is attached to the platform 2024 by a heel hinge at one end of the drum pedal 2081. The other end of the drum pedal 2081 is attached to one end of the pedal rod 2082. The other end of the pedal rod 2082 is attached to the connector rod 2089 with a lever. One end of the connector rod 2089 is attached to one end of the beater extension 2087 which in turn also attached to the beater 2088 on the other end. The other end of the connector rod 2089 is connected to the connector 2086 and biased by spring 2085. The connector 2086 in turn is also connected to the beater mount 2084, which in turn is also connected to kick pedal bar 2083, which in turn is also connected to the platform 2024.

When drum pedal 2081 is pressed downward, it pulls pedal rod 2082 downward, which generates an angular force to overcome the spring biased force from the spring 2085 to force the connector rod 2089 to rotate, which in turn pulls beater extension 2087 toward side 2002A of body 102, which causes beater 2088 to strike side 2002A. When drum pedal 2081 is released, each moving component of drum kick assembly 2080 moves in the opposite direction because the spring force from the spring 2085 rotates the connector rod 2089, which in turn pulls beater extension 2087 away from the side 2002A, returning drum pedal 2081 and beater 2088 into their original positions.

Particular embodiments of go drum 2000 may be acoustic, electric, or MIDI. With the addition of particular types of pickups strategically placed on body 2002 and each of the components, particular embodiments of go drum 2000 may produce an amplified or digitized sound.

Although it is not shown on go drum 2000, body 2002 may have another hole or receptacle attached to body 2002 for the storage and retrieval of drum sticks.

Herein, "or" is inclusive and not exclusive, unless expressly indicated otherwise or indicated otherwise by context. Therefore, herein, "A or B" means "A, B, or both,"

unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

This disclosure encompasses all changes, substitutions, variations, alterations, and modifications to the exemplary embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

The invention claimed is:

1. A compact drum kit comprising:

a multi-sided body having a hollow interior cavity and a sound hole for transmitting sound wave from the interior cavity to exterior of the body, the body has a striking head and an opposing resonant head;

a top plate attaching to a top side of the body;

a platform attaching to a bottom side of the body;

a shaft mounting bracket attaching to the top plate;

a pivot shaft mounting bracket attaching to the top plate;

a plurality of upward extending component mounting shafts supported by one of the shaft mounting bracket and the pivot shaft mounting bracket;

one or more percussion modules that attach to one or more of the plurality of component mounting shafts, wherein each percussion module produces a sound in response to being struck or scraped;

a drum kick assembly positioned on the striking head side of the body and including a beater positioned to strike the striking head of the body to produce a sound; and a hi-hat pedal assembly positioned on the resonant head side of the body.

2. The compact drum kit of claim 1, wherein the hi-hat pedal assembly has a footboard, a base plate and a connector connecting the footboard and base plate.

3. The compact drum kit of claim 2, wherein the base plate is made of a magnetic material.

4. The compact drum kit of claim 3, further comprising a pivot plate pivotally mounted to the platform, wherein the hi-hat pedal assembly is mounted to the pivot plate.

5. The compact drum kit of claim 4, wherein the pivot plate is mounted to the platform through a wing screw that the pivot plate can swivel away from the platform.

6. The compact drum kit of claim 5, wherein the hi-hat pedal assembly is magnetically mounted on the pivot plate.

7. The compact drum kit of claim 6, wherein the hi-hat pedal assembly is mounted on the pivot plate with a variety of locations and/or positions with a variety of directions by disengaging/engaging the magnetic connection between the hi-hat pedal assembly and the pivot plate.

8. The compact drum kit of claim 1, wherein the one or more percussion modules are one or more of a snare drum, tom-tom, a hi-hat cymbals, and a cymbal.

9. The compact drum kit of claim 8, wherein the snare drum is supported by the pivot shaft mounting bracket.

10. The compact drum kit of claim 9, wherein the pivot shaft mounting bracket is adjustably attached to the top plate and is able to pivotally rotate relatively to the top plate.

11. The compact drum kit of claim 10, wherein the pivot shaft mounting bracket is secured into place by a pivot shaft mounting bracket locking mechanism to allow the pivot shaft mounting bracket to rotate freely relative to an axis perpendicular to a longitudinal direction of the pivot shaft mounting bracket or to securely fix pivot shaft mounting bracket into a particular position.

* * * * *